United States Patent [19]

Silbernagel et al.

[11] Patent Number: 4,698,025

[45] Date of Patent: Oct. 6, 1987

[54] LOW PROFILE MODULAR PHONE JACK ASSEMBLY

[75] Inventors: Raymond A. Silbernagel; Gordon W. Funck, both of Naperville, Ill.

[73] Assignee: Molex Incorporated, Lisle, Ill.

[21] Appl. No.: 907,699

[22] Filed: Sep. 15, 1986

[51] Int. Cl.[4] ..... H01R 9/09

[52] U.S. Cl. ..... 439/79; 439/676

[58] Field of Search ..... 339/17 R, 17 C, 17 LC, 339/176 M, 176 MP, 91 R

[56] References Cited

U.S. PATENT DOCUMENTS 4,618,207 10/1986 Silbernagel ..... 339/176 M 4,647,136 3/1987 Kinoshita et al. ..... 339/176 M

*Primary Examiner*—Neil Abrams

*Attorney, Agent, or Firm*—John W. Cornell; Louis A. Hecht

[57] ABSTRACT

A low profile right angle phone jack for use with printed circuit boards is disclosed. The jack includes a dielectric housing member having a modular plug receiving socket formed therein, a forward mating end and a rearward end. The socket is defined by a plug-receiving opening forned in the forward mating end with a lower latch receving region and extends rearwardly to meet a back surface provided in the housing member. The housing member is mounted with its forward mating end disposed beyond an edge of the printed circuit board. The forward mating end of the housing member is offset downwardly so that the lower latch receiving region of the plug receiving opening is below the upper surface of the circuit board. In addition, the housing member cooperates with the printed circuit board surface to define the socket whereby the upper surface of the circuit board is the bottom surface of the socket. The low profile modular jack is for use with printed circuit boards arranged in modern closely-spaced mother-daughter arrangements.

6 Claims, 9 Drawing Figures

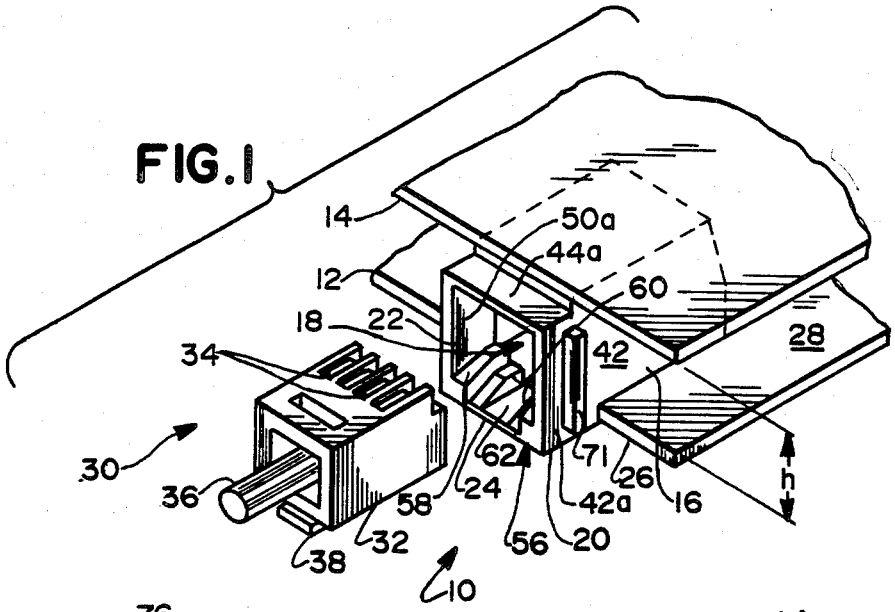
FIG.1
FIG.3
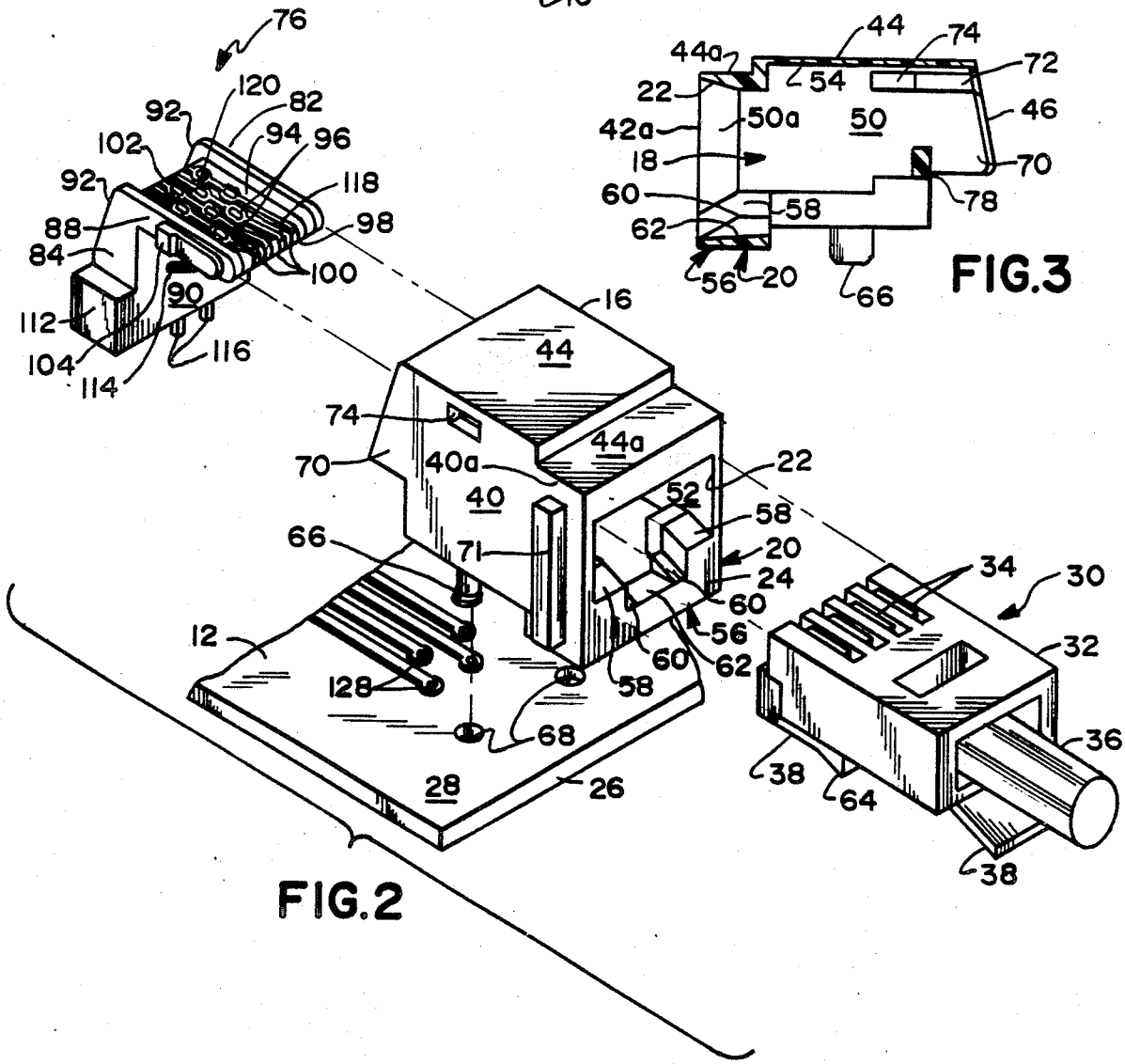
FIG.2

LOW PROFILE MODULAR PHONE JACK ASSEMBLY

BACKGROUND OF THE INVENTION

The present invention relates to modular electrical connectors known as modular phone receptacles or jacks. More particularly, it relates to a new and improved low profile printed circuit board mounted right angle modular phone jack adapted for use in applications where height or space limitations render the use of conventional modular phone jacks mounted in accordance with conventional methods unsuitable.

Modular electrical connectors known as modular phone receptacles or jacks have been known in the art for many years. Although connectors of this type were orginally designed for the telecommunications industry, and in particular for telephones, these connectors have found wide acceptance other than for connecting a telephone to a telephone network. Another common use is as an input/output (I/O) interface with other communications peripheral equipment.

Mounted modular jacks are customarily used to serve as an interface between a standard modular plug and a printed circuit board. Modular phone jacks adapted to receive a conventional modular plug generally comprise a housing with a plug receiving socket formed therein. The socket is defined by a plug receiving opening, opposed top and bottom surfaces joined by opposed side surfaces extending from said opening to join said back surface. A plurality of stamped, metallic elongated conductors are mounted to the housing in some fashion. Each conductor includes a contact portion at one end extending diagonally into the socket, a lead portion at the other end and an intermediate portion between said contact portion and lead portion.

Modular phone jacks may comprise either one piece or two piece units. Illustrative one-piece units employing flat stamped metallic conductors are disclosed in U.S. Pat. Nos. 4,292,736 and 4,315,664. Both of these patents disclose a one-piece dielectric housing having channels formed in the external surfaces thereof which are adapted to locate and hold the flat stamped conductors therein.

In U.S. Pat. No. 4,457,570, a low profile modular phone jack of the one-piece type is disclosed, shown in FIGS. 10 or 11 therein. In accordance with this patent, space savings are achieved by removing the top wall of the connector housing of the modular jack and by inserting the housing into a cut out formed in the printed circuit board member. The low profile connector embodiments shown in FIGS. 10 and 11 possess several shortcomings. For example, they require the use of a less conventional or special order side-latch modular mating plug. Moreover, the printed circuit board must be provided with an additional rectangular cut out to receive the connector housing. The conductors are positioned in the connector manually and therefore these jacks cannot be manufactured by modern lower-cost fully automated methods.

Another low profile modular jack assembly of the one-piece type is described in U.S. Pat. No. 4,497,526. In accordance with a low profile embodiment described in this patent, a printed circuit board is disposed within a housing, having upper and lower housing panels extending parallel to the circuit board. A one-piece modular jack is mounted on the circuit board and a cut out clearance notch is provided in the bottom wall of the jack and in the circuit board respectively.

An upstanding flange is provided which connects the upper and lower housing panels which includes a mating opening which communicates with the socket opening of the circuit board mounted jack. The opening in the flange is provided with a latching shoulder for cooperation with the latch member on the plug. Insertion of the plug member through the flange opening and into the socket permits the latch on the plug to be retained by the retaining means formed by the combination of the latching shoulders in the flange opening and the cut out portions formed in the bottom wall of the jack member and the circuit board.

The structure depicted in this patent has several disadvantages. It requires the use of additional panels to house the circuit board. In mother-daughter arrangements, the invention still would not provide a low profile modular jack which could be used on a plurality of closely spaced parallel circuit boards. The reason for this is that whatever height above the circuit board which is eliminated, is added below the circuit board by the added housing members needed to form the latching means. This structure would merely interfere with corresponding jacks on an adjacent board in a parallel closely-spaced circuit board array such as a mother-daughter arrangement.

In addition to the one-piece modular jack assemblies described above, two-piece modular jacks are known. Typically, two-piece modular phone jack assemblies include a connector housing having a forward end with a plug receiving opening therein, two opposed side walls, the internal surfaces thereof defining socket side surfaces, a top wall joining said side walls and a rearward end with a rear opening formed therein. A carrier subassembly is mounted through the rear opening of the housing. The subassembly has a dielectric support member to which the conductors are mounted and means are provided which cooperate between the housing and the subassembly to lock the subassembly to the housing.

An elegant two-piece modular phone jack is described in U.S. Pat. No. 4,618,207, granted Oct. 21, 1986 and assigned to the same assignee as the present invention. The jack assembly disclosed in said application provides a carrier subassembly for the conductors comprising a support member including a body portion, a horizontal base portion extending rearwardly of the body portion and a generally horizontal cantilevered top portion extending forwardly of the body portion. The conductors are postioned and staked onto the upper surface of the top portion of the support member so that simultaneous forming and positioning of said conductors can occur during the manufacturing process. The two-piece jack disclosed in said U.S. Pat. No. 4,618,207 provides a modular jack of excellent mechanical strength and integrity which can be made by fully automated methods in an extremely low cost manufacturing process. Although the two-piece modular phone jack assembly described in said application provides distinct advantages over prior art two-piece or one-piece assemblies, still lower profile modifications of the one and two-piece type are desired or required for many modern applications.

SUMMARY OF THE INVENTION

In an effort to overcome the limitations of prior art modular jack assemblies, it is a primary object of the present invention to provide a new and improved low profile modular phone jack assembly which may be used to connect printed circuit board members to other components in close-spacing environments where prior art modular jack connectors, primarily because of their heights, cannot be used. Accordingly, the present invention provides a new and improved low profile right angle modular phone jack arrangement of the type that is mounted on an upper surface of a printed circuit board, said jack including:

housing means having a forward mating end, a rearward end and a modular plug-receiving socket formed therein, said socket being defined by a plug-receiving opening formed in the forward mating end with a lower latch-receiving region, opposed top and bottom surfaces joined by opposed side surfaces extending from said plug-receiving opening to join a back surface within said housing;

a plurality of metallic elongated conductors mounted to said housing, each conductor including a contact portion at one end extending from said forward end diagonally into the socket, a lead portion at the other end of an intermediate portion between said contact portion and lead portion; and means for attaching said housing means to said printed circuit board;

the improvement comprising:

said housing means cooperating with the printed circuit board surface to define said socket whereby the upper surface of the printed circuit board disposed generally below said housing means is the bottom surface of the socket;

said housing means being mounted on said printed circuit board so that the forward mating end extends beyond an edge thereof; and said forward mating end being offset downwardly relative to the remaining portion of the housing means so that the lower latch-receiving region of the plug-receiving opening is below the upper surface of the printed circuit board.

The new and improved low profile modular jack assembly of the present invention accomplishes a lower profile by providing a new and improved design for the jack housing means which includes a forward extension of the jack at the forward mating end that includes the plug-receiving opening and the lower latch-receiving region which is downwardly offset so that the latch-receiving region is below the upper surface of the circuit board. In addition, the forward mating end wraps around or overhangs the edge, so that the lower exterior surface of the mating end is aligned with the bottom surface of the circuit board, i.e. The mating end is also flush mounted relative to the underside of the board. Moreover, the new and improved jack housing means provided by the present invention, employs the upper surface of the circuit board to define the bottom surface of the plug-receiving socket, thereby eliminating the need for an added bottom wall in the housing means provided in the prior art housings.

The unique combination of features of this invention including the dropped, over-the-edge forward mating end which provides the plug-receiving opening and the latch retaining feature, together with the absence of a bottom housing wall, advantageously combine to significantly reduce the overall height of the jack assembly in such manner that the new and improved modular plug/-jack connectors may now be used in closely-spaced applications previously foreclosed to plug/jack style connectors.

Other objects and advantages of the present invention will become apparent from the following Detailed Description taken in conjunction with the drawings, in which:

BRIEF DESCRIPTION OF THE DRAWINGS

FIG. 1 is a perspective view of the new and improved low profile right angle modular phone jack of this invention in use, mounted on a printed circuit board which is disposed in closelyspaced relation to an adjacent parallel panel, together with a mateable latch down modular plug;

FIG. 2 is an exploded perspective view of the preferred two-piece low profile right angle modular phone jack of the present invention, together with a mateable latch down modular plug;

FIG. 3 is a side elevational view in cross section of the new and improved housing means for the preferred two-piece low profile modular phone jack of the present invention;

DETAILED DESCRIPTION OF THE PREFERRED EMBODIMENT

Figure 4:
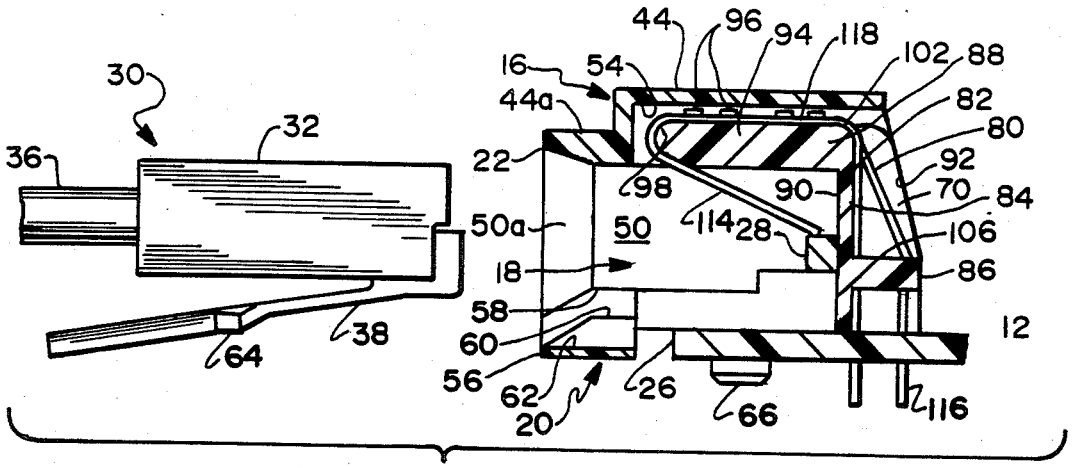
FIG. 4 is a side elevational view in cross section of the assembled new and improved two-piece low profile right angle modular phone jack prior to mounting on a circuit board, together with a mateable latch-down modular plug.

Referring to FIG. 1, the new and improved low profile modular phone jack, generally designated by reference numeral 10, is shown in its intended use, being mounted on a printed circuit board 12 which is located adjacent a closely spaced parallel panel 14. The clearance between adjacent surfaces of the printed circuit board 12 and parallel panel 14 is designated as the distance h. Parallel panel 14 is intended to represent an adjacent printed circuit board, as in a closely spaced-parallel array of daughter boards in a mother-daughter arrangement, or may represent a panel of a component housing enclosing the printed circuit board. In either case, the new and improved low profile right angle modular phone jack 10 of the present invention is intended for use in environments wherein the spacing distance h is less than one inch, more particularly less than about 0.800 inch, and even as low as about 0.600 inch.

Broadly, the new and improved low profile right angle modular phone jack 10 includes a housing member 16 enclosing and defining plug receiving socket 18.

Housing member 16 includes forward mating end 20 having a plug receiving opening 22 and a lower latch receiving region 24 located therein. Forward mating end 20 extends beyond the edge 26 of circuit board 12 and is disposed downwardly relative to the central and rearward portions of housing means 16, such that the lower latch receiving region 24 of forward mating end 20 is below the upper surface 28 of circuit board 12.

Low profile modular phone jack assembly 10 is adapted to receive and mate with a standard latch-down modular phone plug 30. Modular plug 30 generally includes a plug housing 32 having a plurality of terminals 34 therein. The terminals 34 are adapted to electrically contact conductors disposed in socket 18 at one end thereof to conductors (not shown) extending within the plug cord or cable 36 at the other end. A manually actuated flexible lower latch 38 is formed on the plug housing 32 to lock and remove the plug 30 from jack assembly 10.

FIG. 1 generally illustrates the advantageous structural features of the new and improved jack arrangement of this invention provided by housing means 16 with its downwardly offset forward mating end 20 disposed beyond edge 26 so that the lower latch-receiving region 24 in plug receiving opening 22 is below the upper surface 28 of printed circuit board 12. In addition, the lower exterior surface, i.e., the lower most extension of mating end 20 is flush mounted with respect to the underside surface of printed circuit board 12. Furthermore, as will be demonstrated hereinafter, housing means 16 cooperates with printed circuit board 12 to define plug-receiving socket 18, whereby upper surface 28 of circuit board 12 is the bottom surface of socket 18. The new and improved housing means 16 provides a reduction in the height of the overall jack arrangement without adding height or additional structures below the bottom surface of the circuit board. More particularly, in accordance with the present jack arrangement approximately 0.200 of an inch of verticle height is eliminated between the surface 28 of circuit board 12 and the jack housing 16. The modular jack arrangement of the present invention now permits input/output modular jacks to be mounted on several adjacent parallel daughter boards wherein the application requires that the daughter boards be spaced less than about 0.800 of an inch, or even as low as about 0.600 of an inch, apart.

More particularly, and referring now to FIGS. 2–5, a preferred embodiment of the present invention comprising a two-piece low profile modular phone jack arrangement including circuit board 12, housing means 16 and a carrier subassembly 76 is shown. Low profile jack 10 firstly comprises a three-sided housing means 16 defined by two opposed sidewalls 40, 42 and top wall 44 having a downwardly offset forward mating end 20 and a rearward end 46 having a rearward opening 48 defined therein.

Forward mating end 20 includes plug-receiving opening 22 and lower latch-receiving region 24. Surrounding opening 22 are forward extensions **40*a* and 42*a* of opposed sidewalls 40 and 42, respectively, as well as forward top wall extension 44*a* of top wall 44. The internal surfaces 50 and 52 defined by sidewalls 40 and 40*a* and sidewall 42 and 42*a*, respectively, and internal surface 54 defined by top walls 44 and 44*a* together define side and top surfaces of plug receiving socket 18 disposed in housing means 16**.

Opposed from top wall extension **44*a* is lower latch-receiving region 24 which is defined by a lower lip 56 joining sidewall extensions 40*a* and 42*a* in forward mating end 20. Lower lip 56 includes upstanding plug guide members 58, 58 disposed adjacent to and abutting sidewall extensions 40*a* and 42*a*, respectively. Immediately adjacent plug guide members 58 are the latching shoulders 60, 60 which are connected by a latch-receiving trough portion 62 in lower lip 56. Latching shoulders 60 are adapted to engage extensions 64, 64 on lower latch 38 of modular plug 30 as shown in FIG. 4, to retain plug 30 in mating relationship with jack 10. As shown in the drawings the interior side surfaces 50, 52, and top surface, as well as, the upper surfaces of guide members 58 and latching shoulders 60, are all preferrably tapered inwardly from opening 22 into socket 18 to define a flared entry to socket 18 to facilitate insertion and removal of mating plug 30**.

As shown in FIGS. 1 and 2, sidewall 40 is advantageously provided with a vertical locating rib 71 which together with a corresponding vertical locating rib 71 disposed on sidewall 42 (not shown) are adapted to engage the surface of a panel immediately adjacent an opening through which jack assembly 10 is received (also not shown) to provide a flush mount with a mating face of housing 16, if desired.

Sidewalls 40 and 42 are also provided with depending semi-cylindrical mounting bosses 66, 66 respectively, which are received in mounting apertures 68, 68 in printed circuit board 12 to secure housing means 16 thereto. At the rearward end 46 of the housing means 16 sidewalls 40 and 42 are each equipped with a three-sided projection comprising shrouding portions 70, 70 respectively, which define the rear opening 48 in rearward end 46.

Figure 5:
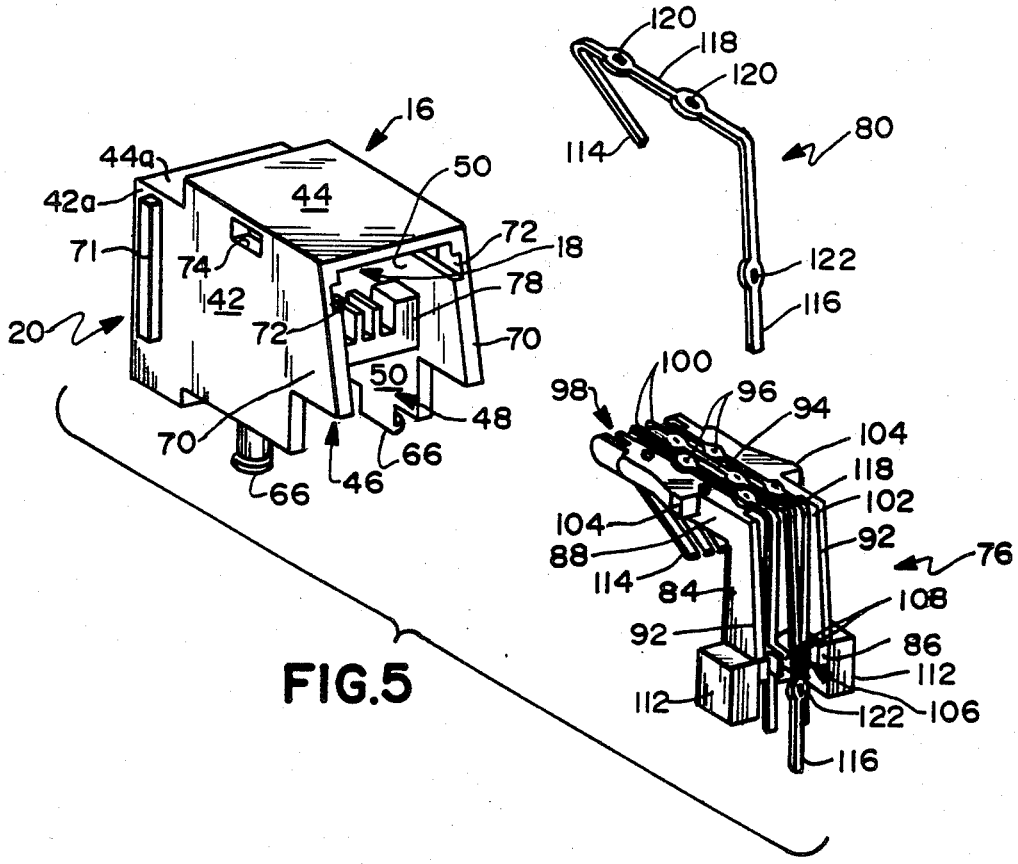
FIG. 5 is an exploded perspective view of the preferred two-piece low profile modular phone jack assembly of the present invention taken from the rear thereof.

As best shown in FIGS. 3 and 5, interior surfaces 50 and 52 are provided with guide channels 72, 72 formed in shrouded portions 70. Guide channels 72 extend forwardly to apertures 74, 74 extending through each sidewall 40 and 42 which serve to interengage with a portion of a carrier subassembly 76 to be more particularly described immediately hereafter.

Also shown in the preferred embodiment of FIG. 5 is a comb structure 78 extending between interior surfaces 50 and 52 adjacent rearward end 46, which is adapted to cooperate with metallic conductors 80 in a manner which will be described more particularly hereafter.

Turning now to the carrier subassembly 76 shown in FIGS. 2 and 5–9, subassembly 76 comprises a dielectric support member 82. Support member 82 is seen to generally comprise a vertical body portion 84 having a rearwardly extending horizontal base portion 86 and a forwardly extending cantilevered top conductor mounting portion 88. The forwardly facing surface 90 of body portion 84 defines the aforementioned back surface of socket 18. The body portion 84 also has a pair of side panel portions 92.

Top mounting portion 88 of support member 82 has an upper surface 94 with a plurality of upstanding staggered locating projections 96. The front end of the top portion 88 has a front edge 98 with a plurality of conductor locating fins 100 formed thereat. The conductors 80 are mounted on the upper surface 94 of the top portion 88, so that a portion thereof extends from the front edge 98 to the rear edge 102.

A pair of side locking wings 104, 104 are provided on the top portion 88. Locking wings 104 are receivable within guide channels 72 and interengage into apertures 74 when the carrier subassembly 76 is mounted to housing means 16.

Figure 7:
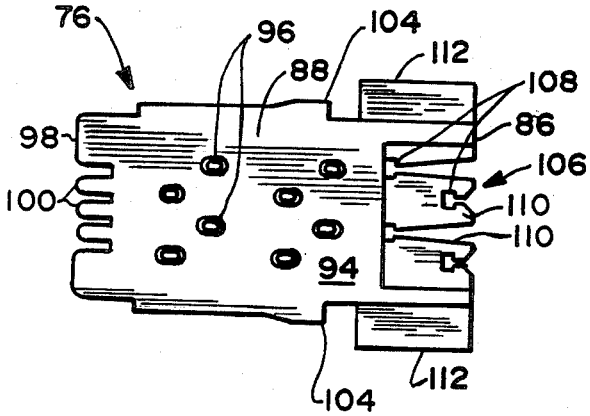
FIG. 7 is a top plan view of a support member comprising a part of the preferred two-piece low profile modular phone jack assembly of the present invention.
Figure 9:
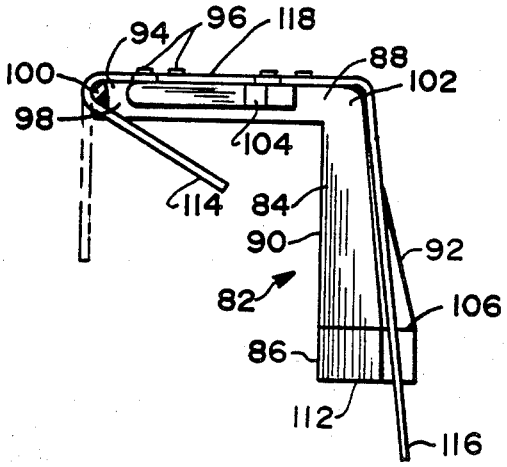
FIG. 9 is an elevational side view of the support member used in the new and improved two piece modular phone jack assembly of the present invention illustrating succeeding steps in the manufacturing process.
Figure 8:
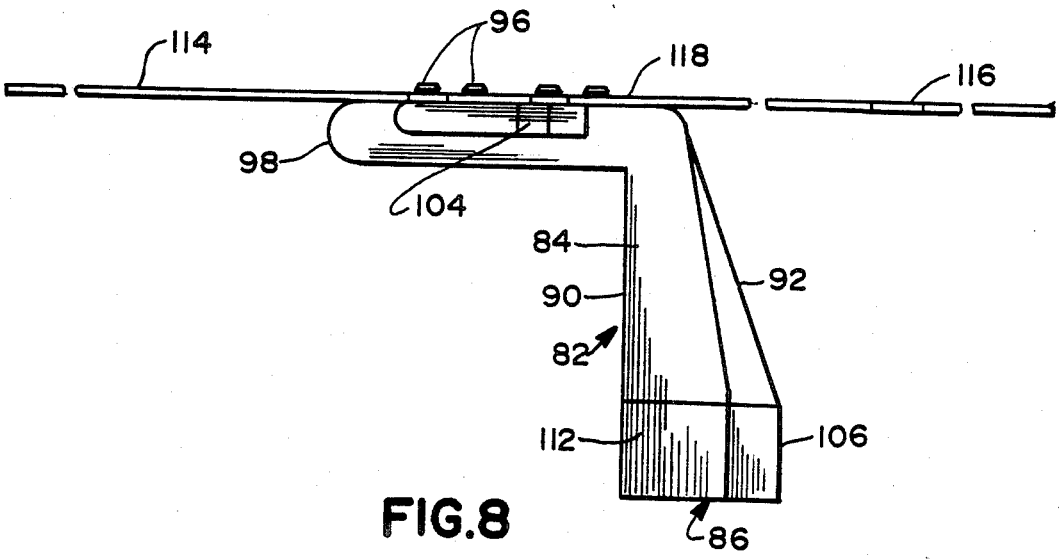
FIG. 8 is an elevational side view of the support member comprising a part of the new and improved two piece modular phone jack assembly of the present invention showing the group of conductors illustrated in FIG. 6 initially mounted at the top thereof.

Base portion 86 has a rearwardly extending staggered conductor receiving structure 106 as best shown in FIGS. 5 and 7 with restricted conductor receiving slots 108 formed therein. Each slot 108 has a tapered guide or thread portion 110 formed rearwardly thereof in order to guide a portion of a conductor 80 therein as shown in FIG. 7.

Extending laterally of the base portion 86 are a pair of standoff block portions 112, 112. Block portions 112 underlie the shrouded portions 70 of the housing means 16 and comprise a rearward extension of sidewalls 40 and 42 when carrier subassembly 76 is mounted within housing 16.

Figure 6:
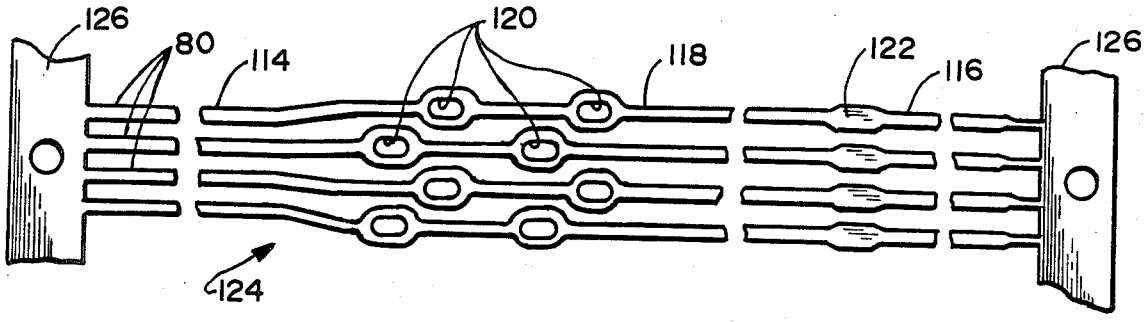
FIG. 6 is a top plan view of a group of metal conductors used in association with the preferred two-piece modular phone jack assembly of the present invention, shown attached at both ends to a carrier strip.

Referring now to FIGS. 5 and 6, each conductor 80 is seen to generally include a contact portion 114 and lead portion 116 and an intermediate portion 118 therebetween. The intermediate portion 118 of each conductor 80 has a pair of spaced apart pilot holes 120 formed therein.

The pilot holes 120 of adjacent conductors are staggered with respect to one another as shown in FIG. 6. Locating projections 96 are adapted to be received within the pilot holes 120 so as to position the conductors 80 on the top surface 94 of top portion 88 of support member 82.

Each conductor 80 also includes a stop shoulder 122 formed on the lead portion 116 thereof. Stop shoulder 122 engages the bottom of the contact receiving structrue 106 so as to prevent accidental removal of the lead portions 116 due to an upwardly directed push out force when the carrier subassembly 76 is mounted within the housing 16. After insertion of the subassembly 76 into housing 16 the inwardly directed contact portions 114 of conductors 80 are positioned and held apart by the comb structure 78 extending along the back wall.

When jack 10 is assembled and mounted onto circuit board 12 it meets all the required specifications and has all the necessary dimensions to receive a standard modular phone plug 30 with a significantly reduced overall height.

In accordance with the present invention, the new and improved low profile two-piece modular phone jack can be manufactured in a low-cost fully automatable process, generally illustrated in FIGS. 6–9.

In accordance with this aspect, a method for making a new and improved low profile modular phone jack comprises:

producing a housing means 16 of the type defined above including the three-sided member having a forward end 20 including a plug-receiving opening 22 and a latch-retaining region 24 which is downwardly offset relative to the three-sided member as an integral unitary molded part;

producing the support member 82 as an integral unitary molded part;

stamping a group 124 of conductors 80 with carrier strips 126 and staggered pilot holes 120 from conductive sheet metal stock;

mounting the group 124 of conductors 80 onto the upper surface 94 of top portion 88 of support member 82 so that upstanding projections 96 are received within pilot holes 120 and securing them by staking over projections 96;

removing the carrier strips 126 and deforming mounted conductors 80 first downwardly and then inwardly to form the diagonally rearwardly directed contact portions 114, and downwardly directed lead portions 116;

securing the lead portions 116 onto base member 86 by positioning the lead portion 116 into the contact receiving structure 106 such that the stop shoulders 122 on the lead portions engage the bottom surface of contact receiving structure 106 and respective receiving slots 108 to prevent accidental removal of lead portions 116 due to an upwardly directed pushout force;

thereafter, carrier subassembly 76 is mounted through rearward opening 48 of housing member 16 by slidingly engaging wings 104 into guide channels 72 until wings 104 snap into retained position within apertures 74 on housing means 16 and conductor contact portions 114 are received in comb structure 78;

the assembled jack 10 is finally edge mounted by placing mounting bosses 66 into mounting apertures 68 on the circuit board and simultaneously positioning lead portions 116 on conductors 80 into footprint apertures 128 placed within circuit board 12 and thereafter electrically connecting the leads 116 to the electrical circuit by, for example, soldering the leads into the footprint apertures 128.

For a more detailed description of the method for making the carrier subassembly, reference should be made to the above-mentioned U.S. Pat. No. 4,618,207.

Although the invention has been described with reference to a two-piece jack which is a preferred embodiment of the present invention; it should be readily apparent to those skilled in this art that housing 16 could be molded to accommodate a one-piece modular phone jack arrangement. Accordingly, in the molding step for a one-piece jack housing, the structure of forward mating end 20 containing the plug receiving opening 22 and the lower latch receiving portion 24 should be molded to be offset and displaced downwardly relative to the remaining portions of the housing 16, so that when the one-piece jack assembly is mounted on a printed circuit board the forward mating end will also overhang the edge of the printed circuit board in a similar fashion. In addition, the housing in a one-piece design should be molded to define a socket member which also utilizes the upper surface 28 of circuit board as the bottom surface of the socket.

As is apparent from the above description, a new and improved low profile modular phone jack is provided in accordance with the present invention. The improvement in the jack assembly is provided by modifying the housing member to include the downwardly offset forward mating end and by modifying the socket defining structures of the housing member to cooperate with the circuit board such that the bottom surface of the socket is defined by the upper surface of the circuit board, to eliminate unnecessary height. The unitary molded structure of the new and improved housing member provides excellent plug retention capability and excellent mechanical strength.

Each of the above-mentioned patents and above-cited application are specifically incorporated herein by reference.

Although the present invention has been described with reference to a preferred embodiment, further obvious modifications or changes can be made by those skilled in this art without departing from the scope and spirit of this invention, as defined by the following appended claims.

What is claimed is:

1. A right angle modular phone jack arrangement of the type that is mounted on an upper surface of a printed circuit board, said jack including:

housing means having a forward mating end, a rearward end and a modular plug-receiving socket being defined by a plug-receiving opening formed in the forward mating end with a lower latch-receiving region, a pair of opposed sidewalls joined by a top wall extending from said plug-receiving opening to join a back surface within said housing;

a plurality of metallic elongated conductors mounted to said housing, each conductor including a contact portion at one end extending from said forward end diagonally into the socket, a lead portion at the other end and an intermediate portion between said contact portion and lead portion; and means for attaching said housing means to said printed circuit board;

the improvement comprising:

said housing means cooperating with the printed circuit board surface to define said socket whereby the upper surface of the printed circuit board disposed generally below said housing means forms a bottom wall of the socket;

said housing means being mounted on said printed circuit board so that the forward mating end extends beyond an edge thereof; and said forward mating end being offset downwardly relative to the remaining portion of the housing means so that the lower latch-receiving region of the plug-receiving opening is below the upper surface of the printed circuit board.

2. The jack arrangement of claim 1 wherein said circuit board further includes an opposed lower surface and the lowermost extension of said forward mating end is flush with the plane defined by said lower surface of the circuit board.

3. The jack arrangement of claim 1 wherein said forward mating end further comprises opposed extensions from each of said oposed sidewalls and a lower lip member joining said opposed sidewall extensions, said lower lip member including the lower latch receiving region defined therein on the upper surface thereof.

4. The jack arrangement of claim 3 wherein said forward mating end further includes a top wall extension joining said side wall extensions, opposite the lower lip member.

5. The jack arrangement of claim 4 wherein the inner surfaces of said lower lip, said topwall extension, and each of said opposed sidewall extensions are tapered inwardly to define a flared entrance extending from said plug receiving opening into said plug receiving socket.

6. The jack arrangement of claim 3 wherein said lower latch receiving region includes a plurality of latching shoulders disposed on the upper surface of said lower lip member at a point intermediate the length of said lower lip member, said latching shoulders being positioned for cooperation with complementary latching extensions included on a latch down modular plug.

* * * * *